United States Patent [19]

Balosetti

[11] 4,174,364

[45] Nov. 13, 1979

[54] PROCESS FOR MANUFACTURE OF POROUS METAL OBJECTS AND USE OF THE PROCESS FOR MANUFACTURE OF A POROUS MOLD

[76] Inventor: Claudio Balosetti, Via Varallo, 244, I-13011 Borgosesia, Vercelli, Italy

[21] Appl. No.: 889,530

[22] Filed: Mar. 23, 1978

[30] Foreign Application Priority Data

Feb. 10, 1978 [CH] Switzerland ..... 1507/78

[51] Int. Cl.[2] ..... B22F 3/16

[52] U.S. Cl. ..... 264/111; 264/120; 264/122

[58] Field of Search ..... 264/111, 122, 120

[56] References Cited

U.S. PATENT DOCUMENTS

| | | | |
|---|---|---|---|
| 2,810,182 | 10/1957 | Brandes | 264/111 |
| 2,979,401 | 4/1961 | Szymaszek | 264/111 |
| 2,994,917 | 8/1961 | Fritsch | 264/120 |
| 3,250,838 | 5/1966 | Bartoszak | 264/111 |

*Primary Examiner*—Robert F. White
*Assistant Examiner*—James R. Hall
*Attorney, Agent, or Firm*—Emory L. Groff, Jr.

[57] ABSTRACT

A process for manufacture of porous metal objects particularly for making porous metal molds for use in the casting of ceramic objects. A mixture of aluminum powder and vegetable or animal ash is subjected to cold molding, followed by heating it in an oven to the softening temperature of the aluminum powder and subsequently hot molding of said mixture.

4 Claims, No Drawings

PROCESS FOR MANUFACTURE OF POROUS METAL OBJECTS AND USE OF THE PROCESS FOR MANUFACTURE OF A POROUS MOLD

The advantage of porous ceramic objects which permit absorption of water by capillarity and simultaneously permit its evaporation are well known.

Thus, cold water contained in a porous ceramic jar keeps its coolness, even in summer, because of a continuous absorption of water by the inside face of the jar wall and an evaporation of water on its external side which is thus refrigerated continuously.

However, the main inconvenience of porous ceramic objects is their fragility. To overcome this inconvenience, the present invention has for its primary object a process for the manufacture of porous metal objects, characterized by the fact that it consists of mixing with aluminum powder with a granulometric fineness of 600 to 25000 mesh per $cm^2$, inclusive, mineral elements of a cellular structure such as are found in the ashes of vegetable or animal organisms or in diatom fossil meal in a proportion of at least 3%. The pulverized mixture is compacted followed by heating in an oven to a temperature between 550° and 660° C., inclusive, and subsequently hot pressed.

This process allows the substitution for commonly used ceramic objects such as jars, cups butter dishes, etc., with more resistant metal objects which have analogous properties because of their porosity. It also has applications, for example, in the field of construction.

An especially important application of this process has also been found for molds for use in the manufacture of ceramic objects.

At the present, plaster molds having the hollowed-out form of the object to be obtained are used for manufacturing ceramic objects by casting. A liquid, clay-based paste with other ingredients dissolved in water, called slip, is poured into it. On contact with the plaster, the water is absorbed by capillarity. The objects thus molded undergo, upon drying, a shrinkage which permits them to be easily removed from the mold. After a subsequent drying operation, the objects are subjected to a "biscuit" firing which gives them their desired characteristics.

The plaster molds can be reused after drying for about 24 hours at a temperature of about 40° C. However, they cannot be reused more than some 50 times that is, once per day for 50 consecutive days. Hence, it is necessary to have available many plaster molds for industrial production of sanitary ceramics, for example.

To overcome this inconvenience, it is proposed by the present invention to manufacture porous metal molds which can be dried and reused more rapidly and also be used for a greater number of casting operations than was possible previously with plaster molds.

By way of example, in an aluminum ball mill there was mixed 9500 grams of aluminum powder with a granulometric fineness of 10,000 mesh per $cm^2$, 500 grams of ash resulting from combustion of rice leaves, passed through a strainer with 10,000 mesh per $cm^2$. This mixture is then compacted so as to give it the form required for molding by slip casting of a ceramic object, keeping in mind the various shrinkages which the mold, on the one hand, and the ceramic object, on the other, will undergo during manufacture.

The mold is then placed in the oven, heated to a temperature of 600° C., at which the aluminum in the compacted powder softens so as to consolidate the mold, while the ash particles maintain its porosity. After this fritting operation, the mold is hot-pressed at the said temperature of 600° C. and the surface is polished.

The advantage of the mold obtained by this process in comparison with the classic plaster mold lies in the fact that it can be quickly dried after use by passing through the oven at a temperature between 100° and 500° C., inclusive, for 5 to 10 minutes. It can thus be reused for a new molding operation by slip casting half an hour later, after cooling. In addition to being reusable several times per day, such a mold has a much greater life than plaster molds, because it deteriorates much less quickly.

Many variations can be envisaged for application of the process for manufacture of porous metal objects described above.

For example, another powdered metal oxide could be added, such as alumina or magnesium oxide, to the powdered mixture along with an increase in the ash content. Good results were obtained especially with the following mixture:

| | |
|---|---|
| Aluminum | 80% |
| Alumina or magnesium oxide | 10% |
| Vegetable ash | 10% |

I claim:

1. A process for the manufacture of porous metal objects comprising (1) mixing aluminum powder having a granulometric fineness of 600 to 25,000 mesh per $cm^2$ with at least 3% of a particulate mineral having a cellular structure and being selected from the group consisting of vegetable ash, animal ash and diatom fossil meal, (2) compacting the admixture to yield an object of sufficient green strength to be self-supporting, (3) heating the said object to a temperature from about 550° C. to about 600° C., and (4) hot pressing said object to yield a unitary porous metal object.

2. A process according to claim 1 wherein a powdered metal oxide is admixed with said aluminum powder and said mineral prior to said compaction.

3. A process according to claim 2 wherein the admixture consists essentially of 80% aluminum powder, 10% alumina powder and 10% vegetable ash.

4. A process according to claim 2, wherein the mixture consists essentially of 80% aluminum powder, 10% alumina powder and 10% animal ash.

* * * * *